US006957707B2

(12) United States Patent
Koivunen et al.

(10) Patent No.: US 6,957,707 B2
(45) Date of Patent: Oct. 25, 2005

(54) METHOD FOR CONTROLLING A DRILLING SEQUENCE, A ROCK DRILLING APPARATUS AND A COMPUTER PROGRAMME TO FORM A DRILLING SEQUENCE

(75) Inventors: Pertti Koivunen, Tampere (FI); Pekka Salminen, Nokia (FI)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/859,078

(22) Filed: Jun. 3, 2004

(65) Prior Publication Data

US 2004/0216922 A1 Nov. 4, 2004

Related U.S. Application Data

(63) Continuation of application No. PCT/FI02/00978, filed on Dec. 3, 2002.

(30) Foreign Application Priority Data

Dec. 3, 2001 (FI) ..... 20012372

(51) Int. Cl.[7] ..... E21B 44/10

(52) U.S. Cl. ..... 175/27; 175/38; 175/113; 173/11

(58) Field of Search ..... 175/113, 114, 122, 175/162, 24, 27, 38, 40, 45, 50; 173/11, 6, 173/5, 2, 167, 140, 141, 148, 152, 161, 163

(56) References Cited

U.S. PATENT DOCUMENTS

| | | | | |
|---|---|---|---|---|
| 3,431,049 A | | 3/1969 | Nordgren | |
| 5,305,836 A | * | 4/1994 | Holbrook et al. | 175/39 |
| 5,439,064 A | * | 8/1995 | Patton | 175/24 |
| 6,460,630 B2 | | 10/2002 | Ahtola et al. | |
| 6,491,115 B2 | * | 12/2002 | Van Houwelingen et al. | 175/27 |

FOREIGN PATENT DOCUMENTS

| | | |
|---|---|---|
| DE | 3902127 A1 | 7/1990 |
| EP | 0 825 330 A1 | 2/1998 |
| FI | 982676 A | 10/2002 |

* cited by examiner

*Primary Examiner*—Frank S. Tsay
(74) *Attorney, Agent, or Firm*—Drinker, Biddle & Reath; Ronald L. Grudziecki

(57) ABSTRACT

A method and a computer program for controlling a drilling cycle in a rock drilling apparatus, and a rock drilling apparatus. In accordance with the invention, each drilling unit in the rock drilling apparatus is monitored during a drilling period, and a drilling sequence of a control unit in the rock drilling apparatus is updated at predetermined intervals during the drilling period. The total time of the drilling and the time elapsed for different operations can be registered. In addition, according to an embodiment, the drilling sequence is changed during updating, if changes occur in the drilling conditions during the drilling period.

18 Claims, 4 Drawing Sheets

METHOD FOR CONTROLLING A DRILLING SEQUENCE, A ROCK DRILLING APPARATUS AND A COMPUTER PROGRAMME TO FORM A DRILLING SEQUENCE

This application is a Continuation of International Application PCT/FI02/00978 filed Dec. 3, 2002 which designated the U.S. and was published under PCT Article 21 (2) in English.

FIELD OF THE INVENTION

The invention relates to a method for controlling a drilling sequence of a rock drilling apparatus comprising a base, at least one drilling unit arranged onto the base, the drilling unit comprising a drilling boom, a feeding beam connected to said drilling boom and a rock drill, which can be moved in relation to the feeding beam, the rock drilling apparatus further comprising a control unit, and the method comprises: forming a drilling plan on the basis of the number, location and dimensions of planned drilling holes before drilling, and storing the drilling plan together with drilling parameters associated with drilling control into the memory of the control unit; forming a drilling sequence in the control unit on the basis of the drilling plan and the drilling parameters, where the drilling order of the holes is determined and the drilling unit is selected for each hole; and drilling in accordance with the drilling sequence the drilling holes determined in the drilling plan in the rock.

The invention also relates to a rock drilling apparatus comprising a base, at least one drilling unit arranged onto the base, the drilling unit comprising a drilling boom, a feeding beam connected to the drilling boom and a rock drill, which is movable in relation to the feeding beam, the rock drilling apparatus further comprising a control unit arranged to form a drilling sequence on the basis of a drilling plan and drilling parameters for drilling holes according to the drilling plan in the rock.

The invention further relates to a computer programme comprising program code, which performed in a processor of a control unit in a rock drilling apparatus causes the control unit to form a drilling sequence on the basis of a drilling plan and drilling parameters fed into the control unit, in which drilling sequence the drilling order of holes to be drilled and a drilling unit to be used for drilling are determined.

BACKGROUND OF THE INVENTION

During the excavation of tunnels a required number of holes is drilled in the rock, and thereafter the holes are charged with explosives and a planned portion of the rock is blasted from the rock. The tunnel proceeds in "rounds". In order to properly loosen the rock during blasting along the entire portion of the round and also in order for the tunnel to have a planned profile and direction, the explosive holes must be carefully drilled. A drilling plan is planned in advance for the rounds, where the dimensions and type of rock in the tunnel are taken into account. The drilling plan determines the number, diameter, length and location of the explosive holes on the back wall of the tunnel. A rock drilling apparatus, which comprises a movable base and drilling booms—typically 1 to 6 thereof—arranged onto the base, is used for drilling holes. Each drilling boom comprises a rock drill. The operator of the rock drilling apparatus is able to control the drilling manually, or alternatively the rock, drilling apparatus is provided with a control unit that automatically attends to the movements of the drilling booms and to the drilling operation. In manual drilling, the ability and experience of the operator of the apparatus play an important part when the measures associated with drilling during one round, i.e. the drilling sequence is to be efficiently controlled. Wide experience is generally required before the operator is capable of controlling a rock drilling apparatus to best possible effect taking both the efficiency and quality factors into account. However, great differences may occur among experienced operators in the total time used for drilling a round. Deficiencies have also been detected in connection with the implementation of the drilling sequence of automatically controlled rock drilling apparatuses. Current control systems are not able to control the drilling to best possible effect, and it is typical that some of the drilling units have already finished the provided tasks, whereas other units are still drilling. In such a situation, the drilling units that have finished their work wait until the other units have finished the drilling holes thereof. It is obvious that drilling is not arranged as effectively as possible, if some of the drilling apparatuses remain unused for a long time when drilling a round.

BRIEF DESCRIPTION OF THE INVENTION

It is an object of the invention to provide a new and improved arrangement for controlling drilling so that the drilling tools is used to best possible effect, and that the drilling time becomes as short as possible.

The method according to the invention is characterized by monitoring the operation of each drilling unit during a drilling period, and updating the drilling sequence in the control unit based on the monitoring during the drilling period.

The rock drilling apparatus according to the invention is characterized in that the control unit is arranged to monitor the operation of each drilling unit during a drilling period and to update the drilling sequence in the control unit based on the monitoring during the drilling period.

The computer program according to the invention is characterized in that the computer program causes the control unit to monitor the operation of the rock-drilling units in the rock drilling apparatus during drilling, and that the computer program causes the control unit to update the drilling sequence based on the monitoring during drilling.

An essential idea of the invention is to monitor the operation of each drilling unit in the rock drilling apparatus during drilling. Based on the information obtained during monitoring, a drilling sequence formed in the control unit of the apparatus based on a drilling plan and drilling parameters is updated. The invention provides such an advantage that the control system is able to take into account the changes occurring during drilling in the drilling conditions, the control parameters or in the drilling tools, and is also able to update the drilling sequence, if need be, to correspond with the changed situation.

An essential idea of an embodiment of the invention is that the drilling sequence is updated at predetermined intervals. The updating time can be selected to take place for instance after certain measures or a particular time period.

An essential idea of an embodiment of the invention is that the time it takes for each drilling unit in the rock drilling apparatus to carry out different operations is measured. The control unit thus constantly registers the total time it takes, for example, to move a drilling unit, to change a drill rod or a drill bit, to drill a reaming hole and the total time elapsed to drill holes in accordance with the drilling plan and the duration of each individual operation. In addition, the control unit measures the penetration rate of each drilling unit, based on which the time it takes to drill holes is estimated. Based on the time spent on different operations and the penetration rate, the control unit updates the drilling sequence. Furthermore, the penetration rate allows obtaining valuable information about the rock to be drilled. The control system is therefore able to observe the properties of the rock to be drilled on different locations of the drilling target and to update the drilling sequence accordingly. The system also observes the differences caused for instance by the drilling parameters, the condition of the drill bit and the individual differences of the drilling units in the penetration rates of the different drilling units.

An essential idea of an embodiment of the invention is that the estimated time of completion of the drilling sequence is calculated in the control unit at predetermined intervals as well as the total drilling time. The calculation becomes more accurate at each time the sequence is updated. Since the calculation is based on actual measurement results, the time of completion can be accurately anticipated well before the drilling is completed, wherefore the following steps of the work can be controlled and prepared better than previously. Thus, the entire excavation process becomes smooth in every way. In addition, the drilling sequence of a round and the information associated with the different measures determined thereby, such as the time elapsed for different operations and the penetration rate, can be utilized in the further development of the excavation process.

An essential idea of an embodiment of the invention is that the total time used for a drilling round, for instance when drilling a tunnel, is minimized by attending to that the drilling operations according to the drilling sequence are distributed as evenly as possible among the drilling units used in the rock drilling apparatus. The control unit distributes the work in such a manner that after each updating round, the remaining operating time in each drilling unit is at least approximately equal. In addition, the control unit tends to minimize the time elapsed for other things than drilling by minimizing for instance the transfer and waiting time of the booms. In an optimal situation, all drilling units finish their work at the same time, whereby no unnecessary stoppage and waiting occur. The advantage of the invention is that the time elapsed in drilling is shortened, as all drilling units are used to best possible effect. This means that the work can be performed more rapidly and the cost effectiveness improves. Moreover, the effects of the changes in rock drilling on the total work cycle can be minimized.

An advantage of the invention is that possible breakages and other stoppages of the drilling units are also taken into account. When the drilling sequence is updated, the work of a damaged drilling unit is re-distributed as evenly as possible among the available drilling units. Furthermore, if a drilling unit can be re-used during a drilling cycle, said drilling unit is provided with operations to be carried out during the following update of the drilling sequence.

A still further advantage of the invention is that the control sequence formed and updated by the control unit can be used as an aid when training new operators. Since the control of manual apparatuses is currently alleviated considerably, the operators are not required to be very experienced. The differences in drilling efficiency between different operators are also reduced.

BRIEF DESCRIPTION OF THE DRAWINGS

The invention is described in greater detail in the accompanying drawings, in which FIG. 1 schematically shows a side view of a rock drilling apparatus according to the invention, FIG. 2 schematically shows a drilling plan of a tunnel, FIG. 3 schematically illustrates a drilling sequence formed by a control unit for implementing the drilling plan according to FIG. 2, FIG. 4 schematically shows a side view of different drillings made for a tunnel and a round, FIG. 5 schematically shows a display unit included in the control unit, and FIG. 6 schematically shows a second display unit.

The invention is simplified in the Figures. For clarity, same reference numerals are used for similar parts.

DETAILED DESCRIPTION OF THE INVENTION

Figure 1:
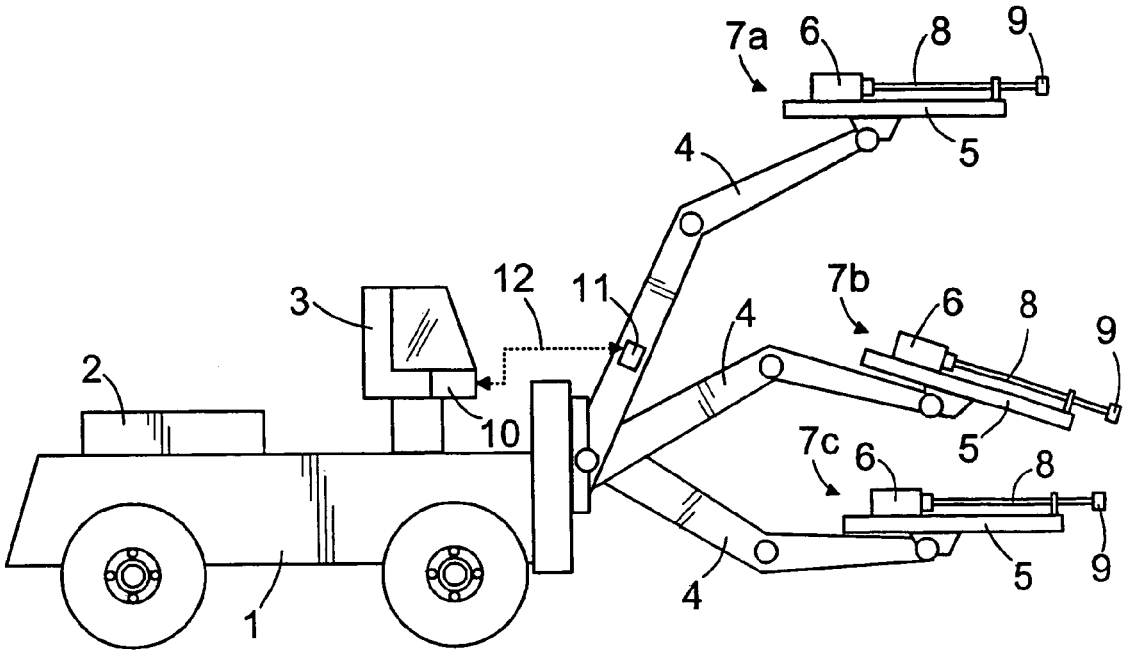

FIG. 1 shows a rock drilling apparatus comprising a base 1, a power unit 2, a control room 3 and in this case at least three drilling booms 4, which can be moved in relation to the base. The free end of each drilling boom 4 comprises a feeding beam 5, to which a rock drill 6 is movably arranged. The entity formed of the drilling boom, the feeding beam, the feeding apparatus and the rock drill is referred to as a drilling unit 7 in this application. For clarity, FIG. 1 does not show any accessory equipment required in drilling, such as equipment associated with changing a drill rod 8 and a drill bit 9. The rock drilling apparatus further comprises a control unit 10 arranged onto the base 1 preferably on a working plane in connection with the controls of the rock drilling apparatus. Location information is for instance transmitted to the control unit 10 using sensors 11 arranged to the drilling units. Furthermore, control commands are transmitted along a control line 12 from the control unit in order to control the drilling units. The rock drilling apparatus may be automatic, in which case the control unit controls the drilling units 7*a* to 7*c*. Alternatively, the drilling units are controlled manually using the controls of the rock drilling apparatus by means of the information obtained form the control unit. The control unit 10 is a device that allows processing the data fed thereto. Typically, the control unit is a computer and the computer program to be carried out in the processor thereof forms a drilling sequence and updates the drilling sequence. The program code can be loaded from an internal memory of the control unit or it may be transferred from a separate external memory means, such as a CD-ROM disc. The program code can also be transferred through a data communication network, for example by connecting the apparatus to the Internet. It is also possible to use a hardware implementation or a combination of a hardware and software solution.

Figure 2:
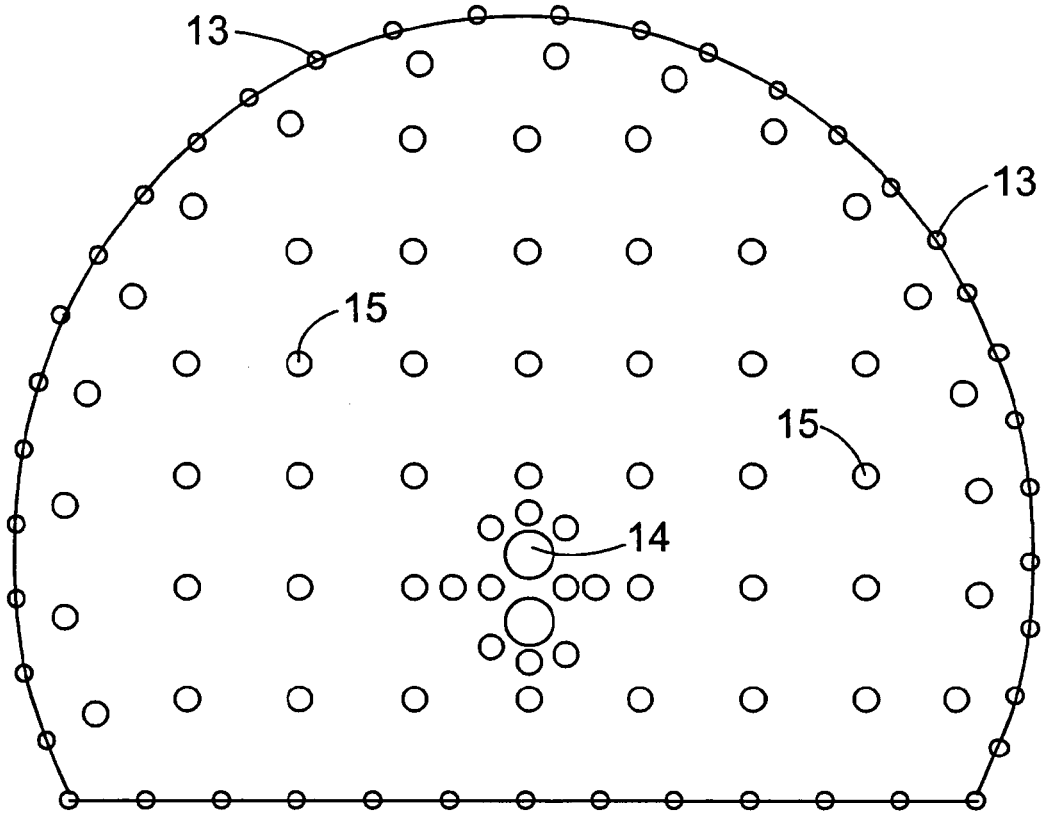

FIG. 2 shows a drilling plan, in which locations for the drilling holes according to a round are indicated on the back wall of the tunnel. The drilling plan is frequently a three dimensional model and it is planned in advance before starting the drillings. The dimensions of the tunnel, the rock type and quality of the rock and the blasting technical matters must at least be taken into account when the drilling plan is drawn up. The number of, for example, profile holes 13 forming the profile of the tunnel and also the number and location of reaming holes 14 and production holes 15 are determined in the drilling plan. In addition, the dimensions, i.e. diameter and length, of each hole is determined in the drilling plan as well as the direction of the hole in relation to the mid-line of the tunnel. For example, the profile holes 13 are generally directed obliquely away from the mid-line of the tunnel (what is known as an look-out angle), in which case the round seen from the side slightly resembles a cone.

Figure 3:
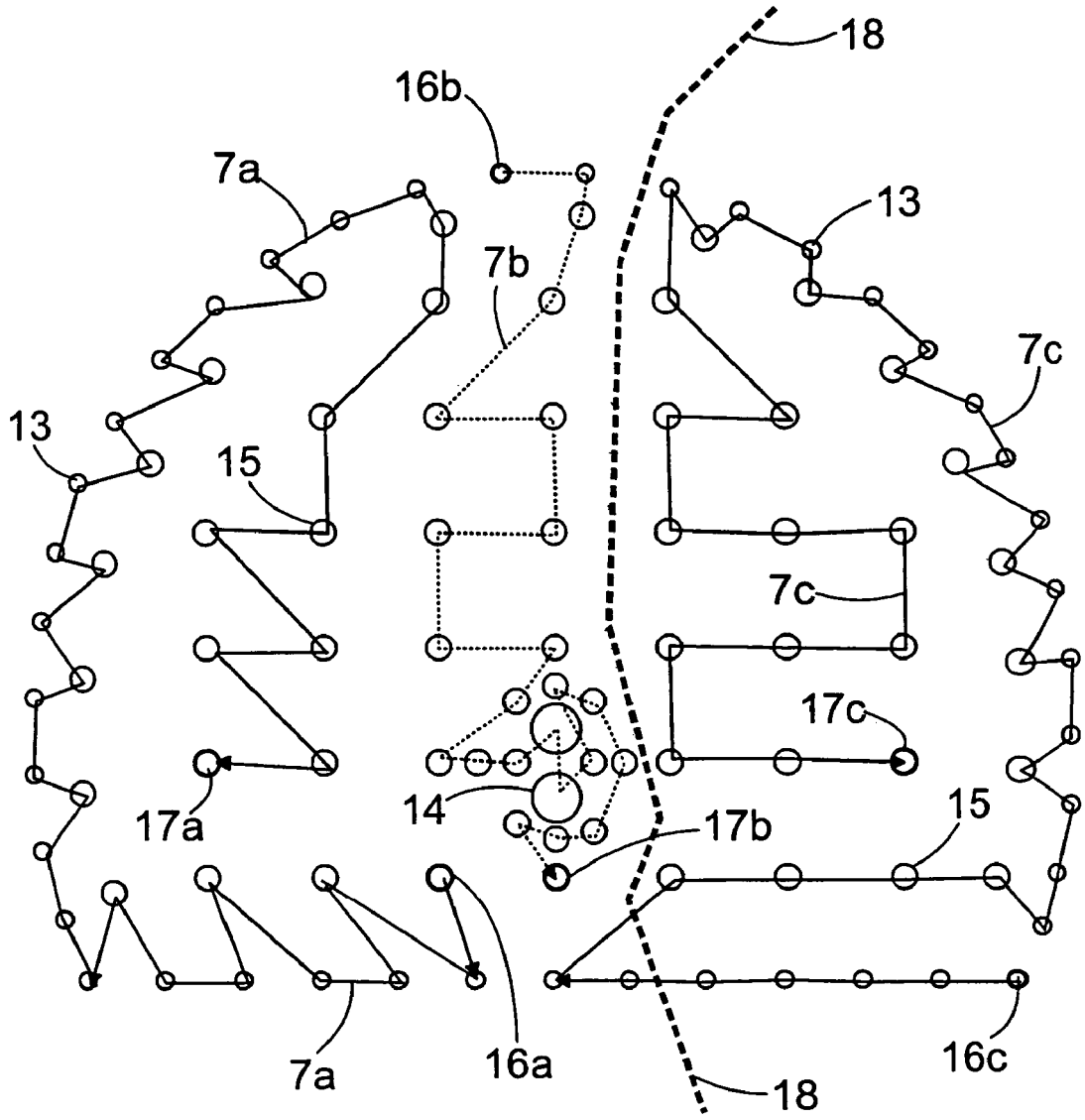

FIG. 3 shows a drilling sequence drawn up in accordance with the drilling plan according to FIG. 2. The drilling sequence is drawn up for a rock drilling apparatus comprising three drilling units. In FIG. 3, an unbroken line indicates the path of a first drilling unit 7*a*, a dashed line indicates the path of a second drilling unit 7*b* and a thin solid line indicates the path of a third drilling unit 7*c*. Moreover, reference numeral 16*a* indicates the starting hole of the first drilling unit 7*a* and reference numeral 17*a* indicates the last hole. Starting holes 16*b* and 16*c* and last holes 17*a* and 17*b* of the two other drilling units are indicated in the same way. In the original drilling sequence, 52 drilling holes are defined for the first drilling unit 7*a* and for the third drilling unit 7*c*. Since the reaming bits 14 having a greater diameter and consequently a longer drilling time are defined for the second drilling unit 7*b*, the number of holes in the second drilling unit 7*b* is smaller than in the two other drilling units. When the drilling of the round is started, the implementation of the drilling sequence in the control unit according to FIG. 3 is initiated. In accordance with the idea of the invention the drilling sequence is changed, for instance, when the type of rock is unexpectedly harder on the portion of the third drilling unit 7*c* than on the portion of the two other drilling units. A thick line 18 in FIG. 3 illustrates the dividing line of the rock type. Since the penetration rate of the drill is smaller when hard rock is concerned, the drilling sequence is modified during updating so that the still un-drilled holes defined for the third drilling unit 7*c* are distributed in accordance with the situation either to the second or third drilling unit.

Figure 4:
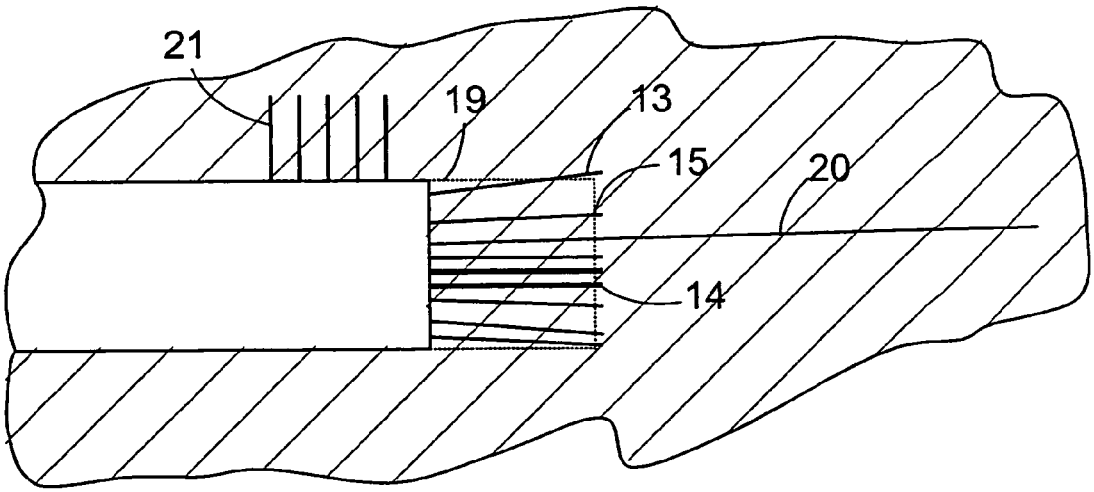

FIG. 4 is a side view showing holes associated with drilling a round 19. In addition to the profile and production holes 13, 15, it is typical to occasionally drill one or more sampling holes 20, based on which the quality of the rock is determined in the travel direction of the tunnel. The sampling hole enables to obtain information about for instance the rock type and whether injection holes must be drilled for sealing the rock with concrete before the round is drilled. Since such sampling holes clearly extend further than the profile and production holes, drilling the sampling holes naturally requires a longer time, which fact the control system of the rock drilling apparatus takes into account when the drilling sequence is formed. In addition, the information obtained about the rock type by means of the sampling hole is also considered when the drilling sequence is updated. Furthermore, when the rock to be excavated is fragmented rock, the tunnel must be reinforced by rock bolts or the like. Consequently, holes 21 in the transverse direction are drilled into the ceiling and walls of the tunnel. Drilling such bolt holes is also taken into account in the drilling sequence.

In FIG. 4, a dashed line indicates the round 19, i.e. the portion that is loosened from the rock when an explosion is carried out. As shown, the rock material is not loosened along the bottom of the holes 13, 15, wherefore the depth of the drilling holes has to be dimensioned so as to be somewhat longer than the planned length of the round. When the following round is started to be drilled, the new drilling holes have to be positioned somewhat differently in comparison with the previous drilling holes of the round for safety and drilling technical reasons. If the operator decides to drill more holes during a drilling cycle, for instance owing to the poor detachment properties of the rock or the damaged structure of the rock, the control system observes the change made in the following updated control sequence.

Figure 5:
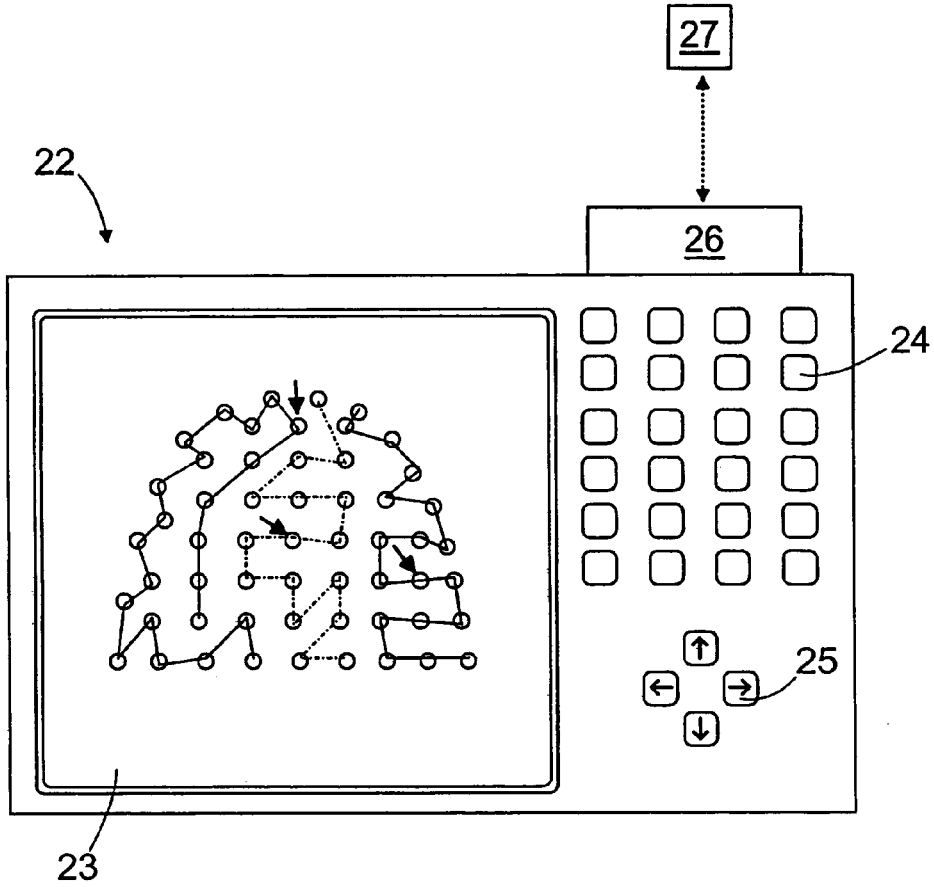

FIG. 5 shows a display unit 22 connected to the control unit, a display 23 of which showing the operator of the rock drilling apparatus the drilled and un-drilled drilling holes. The display unit 22 also comprises a keyboard 24 for feeding data, a controller 25 for moving the cursor on the display and a data transmission unit 26 for transferring data between the rock drilling apparatus and an external unit 27 such as a control room. The data transmission may be wired or wireless. Furthermore, the data transmission unit 26 may be a reading device that reads data stored into separate memory units, such as a floppy disk. Thus, the drilling plan and the drilling parameters can be fed into the control unit, and then again the data gathered when monitoring the drilling units, such as updated drilling sequences and penetration rates, can be transferred from the control unit to be utilized elsewhere.

As FIG. 5 illustrates, the display 23 may show the operator the optimal drilling sequence calculated in the control unit. In practice, this means that the display 23 indicates the following hole to be drilled by each drilling unit. The information provided on the display is updated at the same time as the drilling sequence is updated. If the operator for some reason directs the drilling units 7 from a sequence suggested by the control system in a deviating manner, the control system takes the measures carried out by the operator into account in the following updated drilling sequence thereof.

Figure 6:
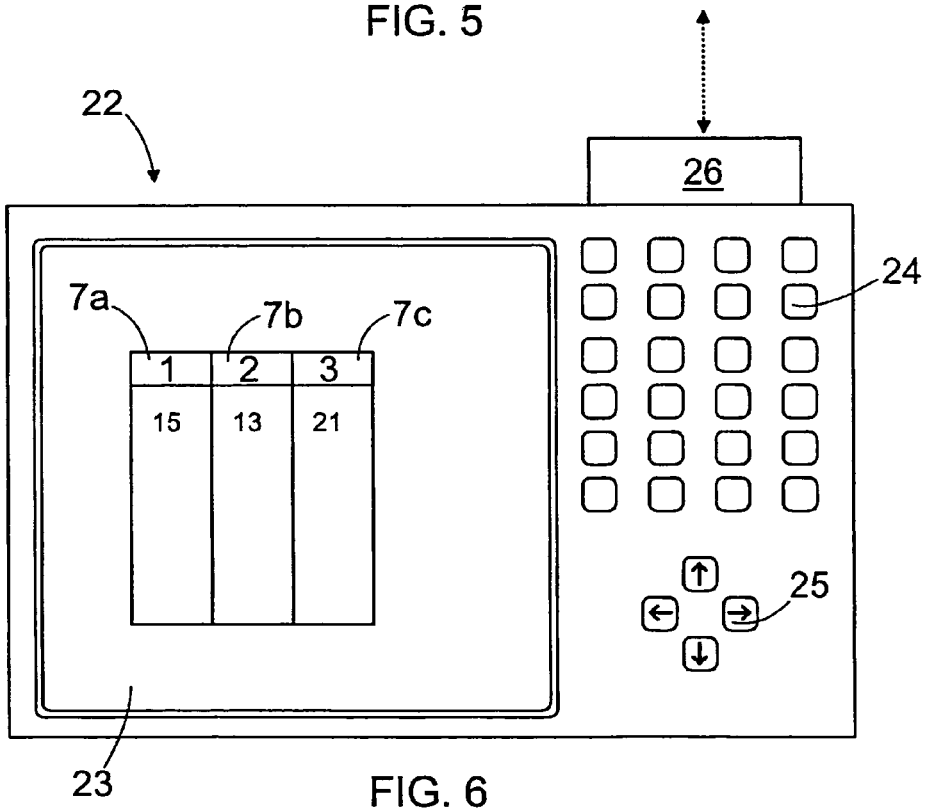

In FIG. 6 the display unit 22 of the control unit 10 in a manual rock drilling apparatus shows the operator the number of un-drilled holes per drilling unit 7*a* to 7*c*. Thus, the operator may determine the drilling sequence for each drilling unit based on the information obtained.

The drawings and the specification associated therewith are merely intended to illustrate the idea of the invention. The details of the invention may vary within the scope of the claims. Therefore, although the invention is described using excavation of a tunnel as an example, the invention is also applicable in other drilling situations.

What is claimed is:

1. A method for controlling a drilling sequence of a rock drilling apparatus, the rock drilling apparatus comprising: a base, at least one drilling unit arranged onto the base, the drilling unit comprising a drilling boom, a feeding beam connected to said drilling boom and a rock drill, which can be moved in relation to the feeding beam, and the rock drilling apparatus further comprising a control unit, the method-comprises:

forming a drilling plan on the basis of the number, location and dimension of planned drilling holes before drilling, and storing the drilling plan together with drilling parameters associated with drilling control into the memory of the control unit;

forming a drilling sequence in the control unit on the basis of the drilling plan and the drilling parameters, where the drilling order of the holes is determined and the drilling unit is selected for each hole;

drilling in accordance with the drilling sequence the drilling holes determined in the drilling plan in the rock, monitoring the operation of each drilling unit during a drilling period, and updating the drilling sequence in the control unit on the basis of the monitoring during the drilling period.

2. A method as claimed in claim 1, wherein
the drilling sequence is updated at predetermined intervals during the drilling period.

3. A method as claimed in claim 1, wherein
the time used for carrying out different operations according to the drilling sequence is measured for each drilling sequence,
the penetration rate of the drilling is measured, and
the drilling sequence in the control unit is updated on the basis of the measurement results.

4. A method as claimed in claim 3, wherein
the estimated total duration of the drilling sequence is calculated on the basis of the measurement results.

5. A method as claimed in claim 1, wherein
the division of still un-drilled holes according to the drilling plan is optimally calculated on the basis of the monitoring among the available drilling units in such a manner that the total duration of the remaining operations in each available drilling unit is approximately equal.

6. A method as claimed in claim 5, wherein
a display unit of the control unit in a manual rock drilling apparatus is used to show the operator the number of remaining un-drilled holes per drilling unit.

7. A method as claimed in claim 5, wherein
the display unit of the control unit in the manual rock drilling apparatus is used to show the operator the optimal drilling order of the remaining undrilled holes and the drilling unit used for drilling each hole.

8. A method as claimed in claim 5, wherein
a drilling cycle of the rock drilling apparatus is automatically controlled using the drilling sequence formed in the control unit.

9. A method as claimed in claim 1, wherein
the updated drilling sequence is stored in a control unit, and the stored drilling sequence is taken into account when a new drilling sequence is formed.

10. A rock drilling apparatus comprising:
a base,
at least one drilling unit arranged onto the base,
the drilling unit comprising a drilling boom, a feeding beam connected to the drilling boom and a rock drill, which is movable in relation to the feeding beam,
a control unit arranged to form a drilling sequence on the basis of a drilling plan and drilling parameters for drilling holes according to the drilling plan in the rock, and wherein
the control unit is arranged to monitor the operation of each drilling unit during a drilling period and to update the drilling sequence in the control unit on the basis of the monitoring.

11. A rock drilling apparatus as claimed in claim 10, wherein
the control unit is arranged to measure the time used for different operations according to the drilling sequence and the penetration rate of the drilling.

12. A rock drilling apparatus as claimed in claim 10, wherein
the control unit is arranged to divide the still remaining un-drilled holes according to the drilling plan among the available drilling units in such a manner that the total duration of the remaining operations in each available drilling unit is approximately equal.

13. A computer programme comprising program code, which performed in a processor of a control unit in a rock drilling apparatus causes the control unit to form a drilling sequence on the basis of a drilling plan and drilling parameters fed into the control unit, in which drilling sequence the drilling order of holes to be drilled and a drilling unit to be used for drilling are determined, and wherein
the computer program causes the control unit to monitor the operation of the rock drilling units in the rock drilling apparatus during drilling, and
the computer program causes the control unit to update the drilling sequence on the basis of the monitoring during drilling.

14. A computer program as claimed in claim 13, wherein
the computer program causes the control unit to update the drilling sequence at predetermined intervals during drilling.

15. A computer program as claimed in claim 13, wherein
the computer program causes the control unit to measure the time used for different operations according to the drilling sequence for each drilling unit,
and to measure the penetration rate of the drilling,
and also to update the drilling sequence on the basis of the measurement results.

16. A computer program as claimed in claim 13, wherein
the computer program allows the control unit to calculate the estimated total duration of the drilling sequence based on the measurement results.

17. A computer programme comprising program code, which performed in a processor of a control unit in a rock drilling apparatus causes the control unit to form a drilling sequence on the basis of a drilling plan and drilling parameters fed into the control unit, in which drilling sequence the drilling order of holes to be drilled and a drilling unit to be used for drilling are determined,
wherein the computer program causes the control unit to monitor the operation of the rock drilling units in the rock drilling apparatus during drilling,
wherein the computer program causes the control unit to update the drilling sequence on the basis of the monitoring during drilling; and
wherein the computer program causes the control unit to calculate on the basis of the monitoring the division of still un-drilled holes according to the drilling plan among the available drilling units in such a manner that the total duration of the remaining operations in each available drilling unit is approximately equal.

18. A computer programme comprising program code, which performed in a processor of a control unit in a rock drilling apparatus causes the control unit to form a drilling sequence on the basis of a drilling plan and drilling parameters fed into the control unit, in which drilling sequence the drilling order of holes to be drilled and a drilling unit to be used for drilling are determined,
wherein the computer program causes the control unit to monitor the operation of the rock drilling units in the rock drilling apparatus during drilling,
wherein the computer program causes the control unit to update the drilling sequence on the basis of the monitoring during drilling; and
wherein the computer program causes the control unit to automatically control a drilling cycle of the rock drilling apparatus using the drilling sequence.

* * * * *